United States Patent [19]

Hattori et al.

[11] 4,075,835

[45] Feb. 28, 1978

[54] ADDITIONAL AIR CONTROL DEVICE

[75] Inventors: Tadashi Hattori, Okazaki; Takamichi Nakase, Gamagori; Hiroaki Yamaguchi, Aichi, all of Japan

[73] Assignee: Nippon Soken, Inc., Nishio, Japan

[21] Appl. No.: 740,173

[22] Filed: Nov. 9, 1976

[30] Foreign Application Priority Data

Nov. 11, 1975 Japan ..... 50-135394

[51] Int. Cl.[2] ..... F02B 75/10

[52] U.S. Cl. ..... 60/276; 123/119 EC; 123/119 VC; 123/124 B; 123/119 D

[58] Field of Search ..... 123/119 EC, 119 E, 119 VC, 123/119 D, 124 R, 124 A, 124 B, 32 EE, 32 EL; 60/276, 285

[56] References Cited

U.S. PATENT DOCUMENTS

| | | | |
|---|---|---|---|
| 3,745,768 | 7/1973 | Zechnall et al. | 123/32 E |
| 3,759,232 | 8/1973 | Wahl | 123/119 D |
| 3,815,561 | 6/1974 | Seitz | 123/32 EE |
| 3,827,237 | 8/1977 | Linder et al. | 123/119 EC |
| 3,960,118 | 6/1976 | Konomi et al. | 123/32 EE |
| 3,973,529 | 8/1976 | Wessel et al. | 123/32 EE |
| 4,019,470 | 4/1977 | Asano | 123/32 EE |
| 4,020,813 | 5/1977 | Hattori et al. | 123/124 B |
| 4,029,061 | 6/1977 | Asano | 123/32 EE |
| 4,031,866 | 6/1977 | Asano | 123/32 EE |

*Primary Examiner*—Wendell E. Burns
*Attorney, Agent, or Firm*—Cushman, Darby & Cushman

[57] ABSTRACT

In controlling an amount of intake air of an internal combustion engine, an error due to the delay time between the time at which the air-fuel ratio changes in the intake system of the engine and the time at which a gas sensor in the exhaust system of the engine senses the changes is compensated. At least two delay factor detectors, e.g., an engine speed sensor and a pressure sensor control the driving and stopping of a drive motor coupled to a control valve mounted in the additional air passage in the intake system to thereby adjust the amount of additional air supply.

4 Claims, 11 Drawing Figures

ADDITIONAL AIR CONTROL DEVICE

The present invention relates to additional air control devices and more particularly to an additional air control device which is capable of suitably compensating the air-fuel ratio of the mixture.

To obtain the maximum of efficiency of the modified internal combustion engines heretofore proposed for automotive exhaust emission control purposes or to ensure the optimum exhaust gas purifying efficiency of the catalyst mounted in engines for exhaust emission control purposes, the air-fuel ratio of the mixture supplied to the engine must always be controlled properly or the amount of secondary air supplied into the catalytic converter must be controlled properly.

In a control device of the above type heretofore proposed, the oxygen content of the exhaust gases, for example, is sensed by a gas sensor to detect the air-fuel ratio of the mixture and a control valve is operated in response to the output signal of the gas sensor to continuously control the amount of additional correcting air to gradually decrease or increase it, thus accomplishing feedback control of the air-fuel ratio of the mixture.

In this type of control apparatus, generally a motor is employed for operating the control valve and the time rate of change of the controlled air-fuel ratio is dependent on the rate of change of the passage area for the additional air flow which is controlled by the motor. Consequently, the control of air-fuel ratio is accomplished by presetting the motor driving speed to the optimum speed so that the control range of air-fuel ratio is minimized under the steady-state conditions as well as the transient conditions, such as the acceleration or deceleration of the engine.

However, the conventional control device of this type is disadvantageous in that since the device employs an integral control system which controls the air-fuel ratio continuously and moreover the effects of other factors are not practically taken into consideration, even if the driving speed is preset to the optimum value as mentioned previously, due to the fixed driving speed, the air-fuel ratio is varied considerably under the effect of a factor, e.g., a delay time factor between the occurrence of a change of the air-fuel ratio in the intake system and the time that the gas sensor senses the change in the exhaust system, thus failing to ensure satisfactory control of the air-fuel ratio.

Particularly, in the light load, low rotational speed range where the amount of intake air is small, the delay time is increased causing a hunting phenomenon and thereby failing to ensure full display of the cleaning ability of the catalyst and moreover a surging phenomenon is caused during running of the vehicle with the resulting deterioriation of its drivability. Thus, there is much room for improvements on this type of control device.

With a view to overcoming the foregoing difficulty, it is an object of the present invention to provide an additional air control device wherein the running and stopping of a drive motor are alternately and intermittently controlled in a skip fashion by a control circuit to satisfactorily control the amount of additional air supply under the steady-state conditions as well as the transient conditions so that as for example, the control range of the air-fuel ratio is always maintained small and thus the air-fuel ratio of mixture is maintained constant.

It is another object of this invention to provide such additional air control device wherein the ratio of the driving time period to the rest time period of a control valve is controlled in response to at least two different delay time factors, preferably the engine rotational speed and intake manifold vacuum to eliminate any inconvenience due to the delay time factors and ensure satisfactory control of the additional air flow, thus ensuring full display of the ability of the catalyst and eliminating the occurrence of any surging phenomenon to ensure an improved drivability.

The present invention, when applied for example to the control of the air-fuel ratio of mixture, has a great effect of maintaining the control range of the air-fuel ratio at a small value thus ensuring an effective use of the catalyst as well as a remarkable effect of eliminating the occurrence of surging phenomenon in the light load, low speed range due to an excessive supply of additional air thus ensuring an improved drivability.

These and other objects, features and advantages of the present invention will be apparent from the following detailed description taken in conjunction with the accompanying drawings, in which.

Figure 1:
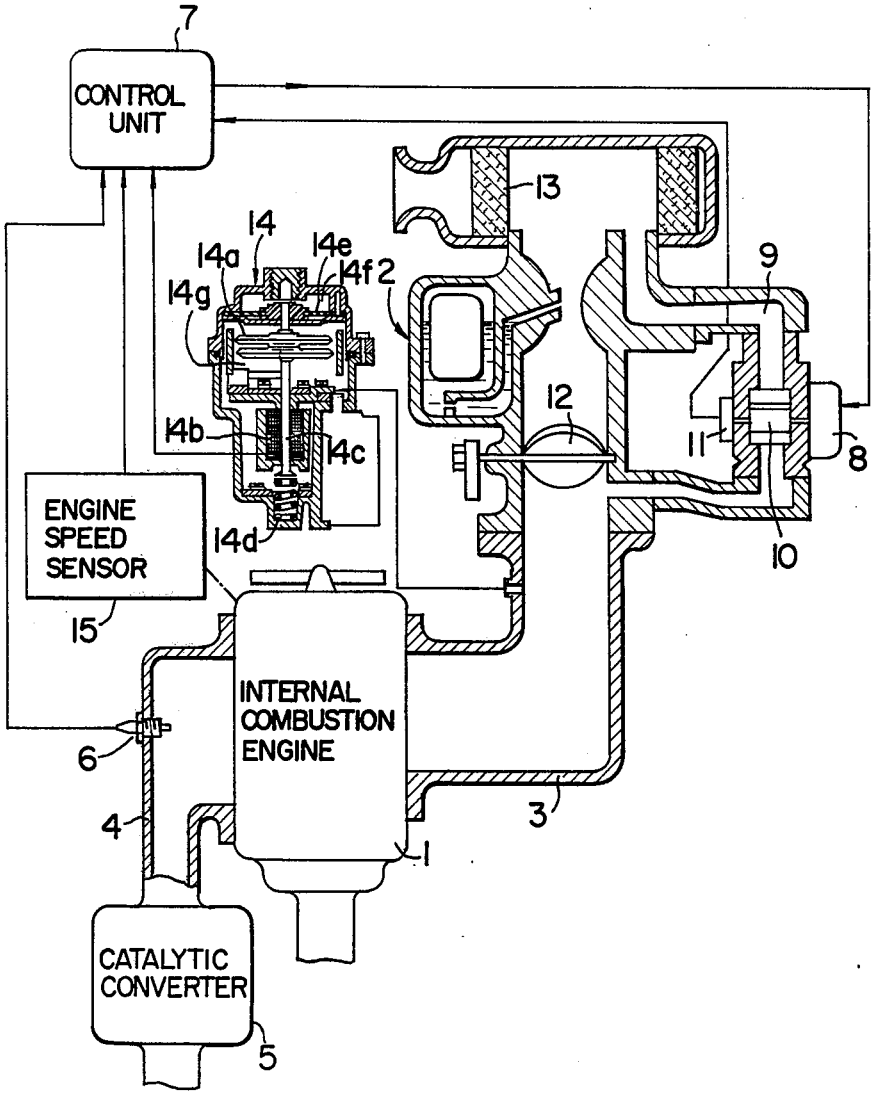
FIG. 1 is a schematic diagram showing the overall construction of an embodiment of the present invention.

Referring to FIG. 1 illustrating the overall system of the invention, an internal combustion engine 1 is the conventional spark-ignition, four-cycle engine and air-fuel mixture is supplied to the engine 1 by a carburetor 2 through an intake manifold 3. The carburetor 2 having a main passage, is of the conventional type and it has been set to produce an air-fuel mixture which is slightly rich as compared with the desired air-fuel ratio demanded by the engine 1 or a catalytic converter 5.

Figure 2:
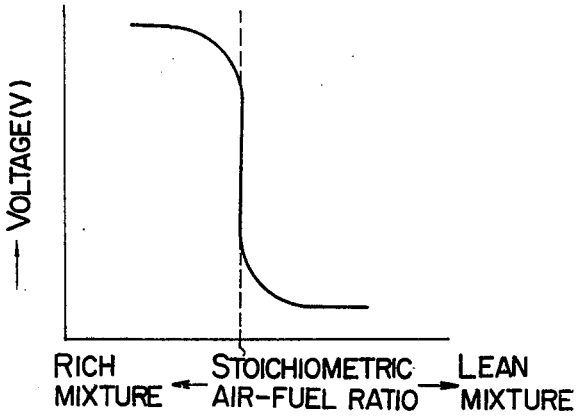
FIG. 2 is a characteristic diagram showing the output of the gas sensor shown in FIG. 1.

Disposed in the exhaust system of the engine 1 are an exhaust manifold 4 and a three-way catalytic converter 5 and also mounted in the exhaust manifold 4 is a gas sensor 6 which detects by a metal oxide such as zirconium dioxide or titanium dioxide the content of oxygen, a constituent, of the exhaust gases. Where the gas sensor 6 employs zirconium dioxide, for example, as shown in FIG. 2, the gas sensor 6 comes into operation at around the atoichiometric air-fuel ratio so that when the detected air-fuel ratio is rich (small) as compared with the stoichiometric one, it produces an electromotive force between 80 and 100 mV, whereas when the detected air-fuel ratio is lean (large) as compared with the stoichiometric one, the resulting electromotive force is on the order of 10 to 0 mV. An electronic control unit 7 is responsive to the signals from the gas sensor 6, etc., to drive a four-phase pulse motor 8 in a selected direction. The pulse motor 8 operates a control valve 10 mounted in an additional air passage or a bypass passage 9 to open and close and the drive shaft of the pulse motor 8 is connected to the control valve 10. The control valve 10 is a known butterfly valve and there is provided a valve-fully-closed switch 11 so that when the control valve 10 is in its fully closed position, this is detected and a fully closed position signal is produced and applied to the control unit 7.

In the intake system, a throttle valve 12 is mounted in the downstream portion of the carburator 2 and the upstream portion of the carburetor 2 includes an air cleaner 13 and the downstream portion thereof includes a pressure sensor 14 constituting first delay time factor detecting means. The additional air passage 9 is disposed so as to communicate the air cleaner 13 with the downstream side of the throttle valve 12.

Figure 3:
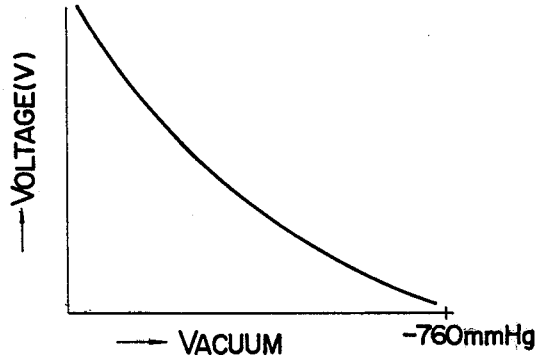
FIG. 3 is a characteristic diagram showing the output of the pressure sensor shown in FIG. 1.

The pressure sensor 14 converts pressure variations in the intake manifold 3 into voltage variations and it comprises a bellows **14*a* forming a vacuum inside, a core 14*c* of a differential transformer 14*b* which is coupled to the bellows 14*a*, a spring 14*d* and an atmospheric pressure chamber 14*f* and a vacuum chamber 14*g* which are separated from each other by a diaphragm 14*e*, whereby when a change occurs in the intake manifold pressure, the bellows 14*a* is deformed so that the core 14*c* is moved and this movement is converted into a voltage by the differential transformer 14*b*, that is, its output voltage decreases as the intake manifold vacuum becomes high (i.e., becomes more vacuum) as shown in FIG. 3. The output terminal of the differential transformer 14*b* is electrically connected to the control unit 7**.

An engine speed sensor 15 which detects and converts the rotational speed of the engine 1 into an electric signal, constitutes second delay detecting means and in the present embodiment it comprises the spark ignition coil of the engine 1 so that the primary voltage of this ignition coil is taken out as its output signal, namely, the primary voltage takes the form of a pulse signal (digital signal) having a frequency corresponding to the rotational speed of the engine 1.

Figure 9:
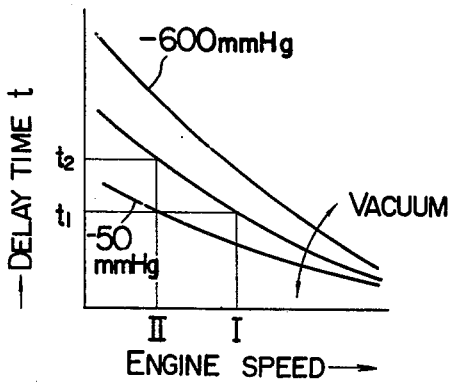
FIG. 9 is a characteristic diagram showing the relationship between the engine rotational speed and the system delay time.

There is shown in FIG. 9 the relation among intake vacuum, engine speed and the delay time from the time a change of the air-fuel ratio occurs in the intake system to the time the gas sensor 6 in the exhaust system senses the change. In the figure, the delay time becomes larger as the intake vacuum becomes higher, i.e., more vacuum, and the delay time becomes shorter as the engine speed becomes faster. Accordingly, the intake vacuum and engine speed are a function of the delay time and constitute delay factors.

Figure 4:
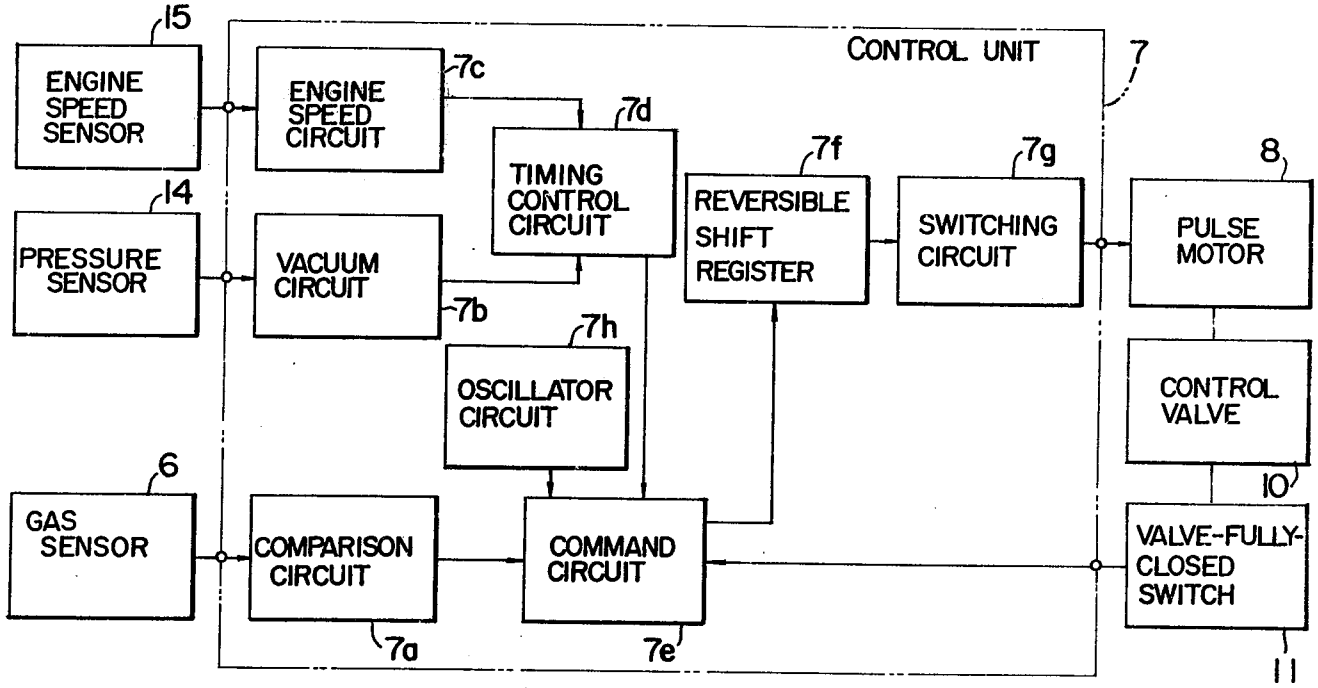
FIG. 4 is a block diagram of the electronic control unit shown in FIG. 1.
Figure 6:
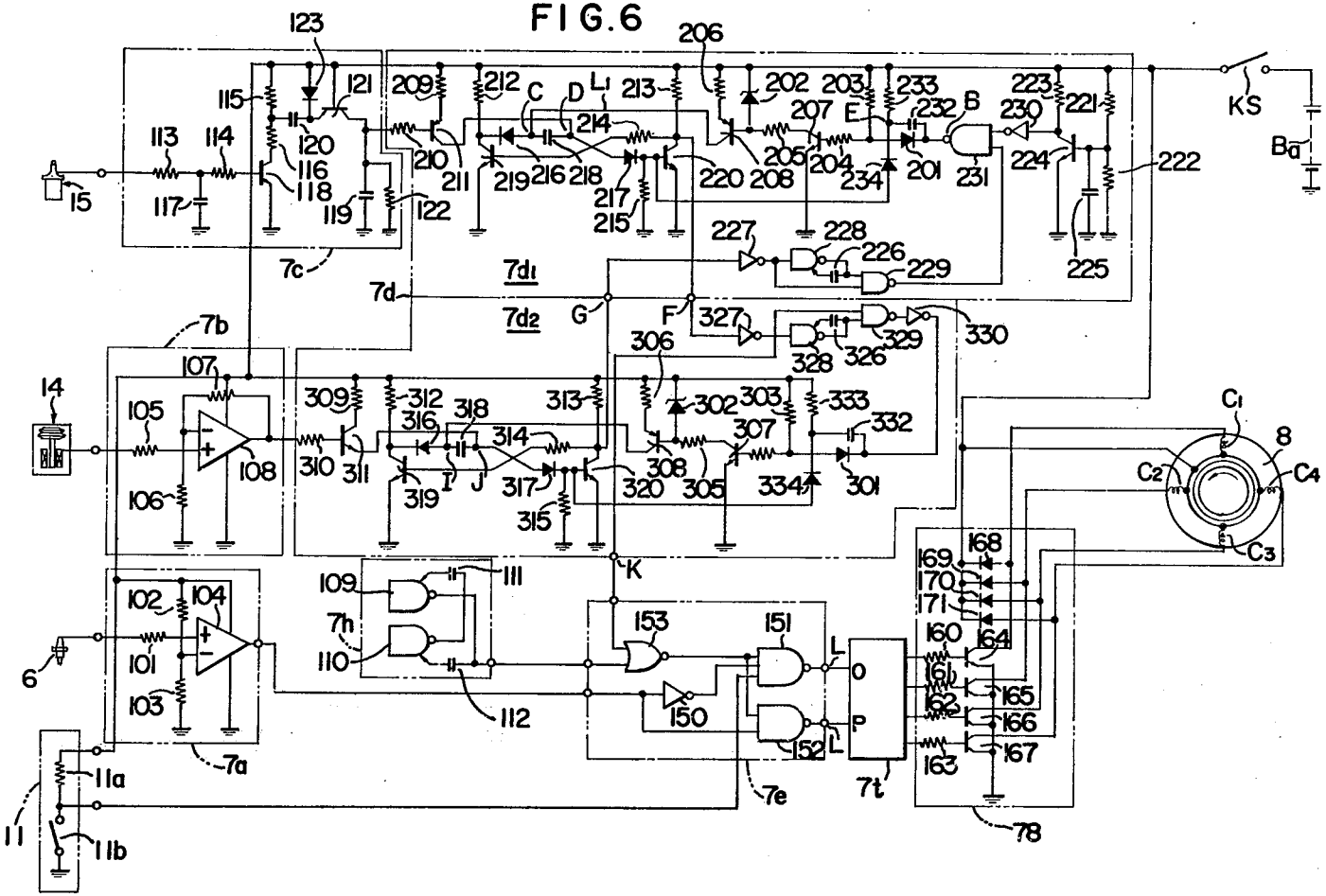
FIG. 6 is a circuit diagram of the control unit shown in FIG. 4.

Next, the electronic control unit 7 will be described with reference to the block diagram shown in FIG. 4. The control unit 7 receives as its input signals the signal from the gas sensor 6, the signals from the pressure sensor 14 and the engine speed sensor 15 respectively corresponding to the intake manifold vacuum and the engine rotational speed which are the delay time factors and the signal from the valve-fully-closed switch 11, and the control unit 7 comprises a comparison circuit **7*a*, a vacuum circuit 7*b*, an engine speed circuit 7*c*, a timing control circuit 7*d*, a command circuit 7*e*, a reversible shift register 7*f*, a switching circuit 7*g* and an oscillator circuit 7*h*, whereby the pulse motor 8** is operated in accordance with these input signals.

With this construction, basically the air-fuel mixture produced in the carburetor 2 is burned in the combustion chambers of the engine 1 and thereafter any change in the air-fuel ratio is detected in the exhaust system by the gas sensor 6 whose output signal is in turn applied to the comparison circuit **7*a* where the air-fuel ratio is determined whether it is rich or lean as compared with the preset air-fuel ratio to be controlled (the stoichiometric air-fuel ratio), so that when the air-fuel ratio is rich the pulse motor 8 operates the control valve 10 mounted in the additional air passage 9 in a direction which opens it, whereas when the air-fuel ratio is lean the control valve 10** is operated in a direction which closes it.

In this case, the timing control circuit **7*d* determines the running time and stopping time of the pulse motor 8 in accordance with the signals from the pressure sensor 14 and the engine speed sensor 15 constituting the system delay detecting means, so that the running and stopping of the pulse motor 8 are effected alternately and intermittently through the command circuit 7*e*, the reversible shift register 7*f* and the switching circuit 7*g***.

Thus, by properly controlling the driving direction as well as the running time of the pulse motor 8 so as to intermittently operate the control valve 10 in a skip movement fashion, the additional air flow is properly controlled and the air-fuel ratio of mixture is compensated by the additional air supplied to the down-stream side of the throttle valve 12, thus controlling the air-fuel ratio of mixture to always attain the preset air-fuel ratio, e.g., the stoichiometric air-fuel ratio when using a three-way catalytic converter 5, satisfactorily with a reduced control range.

The electronic control unit 7 will now be described in greater detail with reference to FIGS. 4 to 7. In the electronic control unit 7, the comparison circuit **7*a* comprises an input resistor 101, voltage dividing resistors 102 and 103 and a differential operational amplifier 104 (hereinafter referred to as an OP AMP), and the OP AMP 104 has its noninverting input terminal connected to the gas sensor 6 through the input resistor 101 and its inverting input terminal connected to the voltage dividing point of the voltage dividing resistors 102 and 103. Thus, the comparison circuit 7*a* compares its input voltage with a preset voltage preset by the voltage dividing resistors 102 and 103 (i.e., the voltage practically equal to the electromotive force produced by the gas sensor 6** at around the stoichiometric air-fuel ratio), so that a "1" level output is produced at its output terminal A when the input voltage is higher than the preset voltage or richer than the stoichiometric air-fuel ratio, whereas a "0" level output is produced at the output terminal A when it is lower than the preset voltage or leaner than the stoichiometric air-fuel ratio.

The vacuum circuit **7*b* comprises resistors 105, 106 and 107 and a noninverting amplifier consisting of an OP AMP 108 and the noninverting input terminal of the OP AMP 108 is connected through the resistor 105 to the output terminal of the pressure sensor 14 thus amplifying the output of the pressure sensor 14** with a gain $$\left(1 + \frac{\text{resistance value of resistor 107}}{\text{resistance value of resistor 106}}\right).$$

Figure 5:
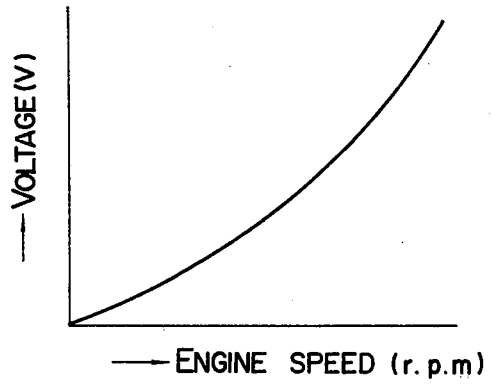
FIG. 5 is a characteristic diagram showing the output of the engine speed circuit shown in FIG. 4.

The engine speed circuit 7c comprises a waveform shaping circuit including resistors 113, 114, 115 and 116, a capacitor 117 and a transistor 118 and constituting an input stage, and an output stage or a D-A (digital-analog) converter circuit including capacitors 119 and 120, a transistor 121, a resistor 122 and a diode 123, so that the digital pulse signal from the engine speed sensor 15 is subjected to D-A conversion and an analog voltage is produced which is substantially proportional to the rotational speed of the engine 1 as shown in FIG. 5.

The timing control circuit 7d comprises two control circuits, i.e., a running time control circuit $7d_1$ and a stopping time control circuit $7d_2$. The running time control circuit $7d_1$ comprises a charging circuit including a diode 201, a Zener diode 202, resistors 203, 204, 205 and 206 and transistors 207 and 208, a discharging circuit including resistors 209 and 210 and a transistor 211, a monostable circuit including resistors 212, 213, 214 and 215, diodes 216 and 217, a capacitor 218 and transistors 219 and 220, and a trigger circuit including resistors 221, 222, 223 and 233, a transistor 224, capacitors 225, 226 and 232, inverters 227 and 230, NAND gates 229 and 231, a NAND gate 228 with an expander terminal and a diode 234.

The stopping time control circuit $7d_2$ is a circuit which is similar to the running time control circuit $7d_1$ and it comprises a charging circuit including a diode 301, a Zener diode 302, resistors 303, 304, 305 and 306 and transistors 307 and 308, a discharging circuit including resistors 309 and 310 and a transistor 311, a monostable circuit including resistors 312, 313, 314 and 315, diodes 316 and 317, a capacitor 318 and transistors 319 and 320, and a trigger circuit including a resistor 333, capacitors 326 and 332, inverters 327 and 330, a NAND gate 329, a NAND gate 328 with an expander terminal and a diode 334.

In operation, when a key switch KS is turned on thus connecting the circuit to a power source Ba, in the trigger circuit of the running time control circuit $7d_1$ the transistor 224 is turned off for the duration of a time determined by the resistors 221 and 222 and the capacitor 225 and the output of the inverter 230 goes to the "0" level. Consequently, during this time interval the output of the NAND gate 231 receiving the output of the inverter 230 goes to the "1" level irrespective of the input signal at the other input and thus the transistors 207 and 208 are both turned on.

On the other hand, the circuit constants of the monostable circuit in the running time control citcuit $7d_1$ and the stopping time control circuit $7d_2$, respectively, are so preset that the transistors 220 and 320 are turned on when the key switch KS is closed.

Figure 7:
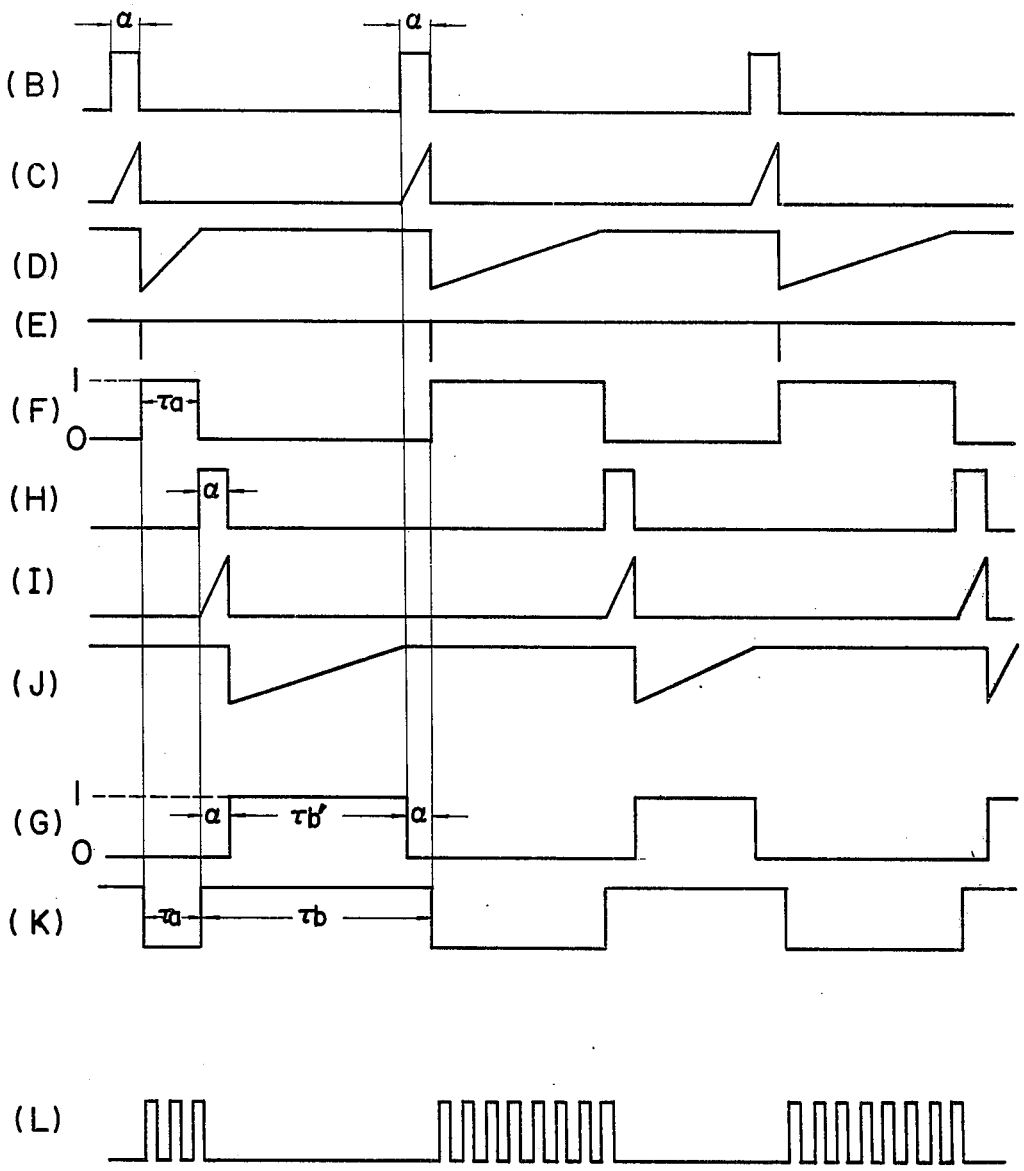
FIG. 7 is a diagram showing the voltage waveforms produced at various points in the control unit shown in FIG. 6.

Thus, during a predetermined time after the closing of the key switch KS, the capacitor 218 of the monostable circuit is charged through a conductor $L_1$, etc., with a constant current determined by the Zener diode 202 and the resulting charging voltage waveform at its terminal C is shown in (C) of FIG. 7. Then, as the transistor 224 is turned on so that the output of the NAND gate 231 goes to the "0" level, a negative trigger signal is produced at a terminal E of the capacitor 232 as shown in (E) of FIG. 7 and the transistor 220 of the monostable circuit is turned off. When the transistor 220 is turned off in this way, the transistor 219 is turned on and the charge stored in the capacitor 218 is discharged through the diode 216 and the transistor 219. Here, the collector of the discharging circuit transistor 211 is connected to the other terminal D of the capacitor 218 and the signal from the engine speed circuit 7c is applied to the base of the transistor 211. Thus, the capacitor 218 discharges in response to the output signal of the engine speed circuit 7c which is proportional to the rotational speed of the engine 1 and the resulting discharge voltage waveform produced at the terminal D of the capacitor 218 is shown in (D) of FIG. 7.

When the discharge potential at the terminal D rises as shown in (D) of FIG. 7 thus completing the discharging of the capacitor 218, the transistor 219 is turned off and simultaneously the transistor 220 is turned on. In other words, the transistor 220 is turned off for a determined period corresponding to the rotational speed of the engine 1 (e.g., the discharging time of the capacitor 218) and consequently the voltage waveform at an output terminal F of the running time control circuit $7d_1$ which is delivered from the collector of the transistor 220 has a waveform so that a time period $\tau_a$ during which the voltage waveform remains at the "1" level varies in accordance with the engine rotational speed.

The output voltage of the running time control circuit $7d_1$ is inverted by the inverter 327 in the stopping time control circuit $7d_2$ and it is then applied to the NAND gates 328 and 329. Thus, after the output of the inverter 327 has gone from the "0" to "1" level (namely, after the voltage waveform shown in (F) of FIG. 7 has gone from the "1" to "0" level), the NAND gate 328 produces a "1" level signal for a time period $\alpha$ which is determined by the capacitor 326 connected to its expander terminal and thus the inverter 330 which inverts the output of the NAND gate 329 produces a "1" level signal only for the time period $\alpha$ as shown in (H) of FIG. 7.

Thus, when the output of the inverter 330 goes to the "1" level, the transistors 307 and 308 are turned on so that in a similar manner as in the case of the running time control unit $7d_1$, the capacitor 318 is subjected to constant current charging as well as discharging so that the voltages at terminals I and J respectively vary as shown in (I) and (J) of FIG. 7 and the transistor 320 is turned off for a determined time period in accordance with the vacuum signal from the pressure sensor 14. Consequently, the voltage waveform at an output terminal G of the stopping time control circuit $7d_2$ which is delivered from the collector of the transistor 320 has a waveform such that a time period $\tau_b$ during which the waveform remains at the "1" level varies in accordance with the intake manifold vacuum as shown in (G) of FIG. 7.

The output voltage of the stopping time control circuit $7d_2$ is inverted by the inverter 227 of the running time control circuit $7d_1$ and it is then applied the the NAND gates 228 and 229. Thus, after the output of the inverter 227 has gone from the "0" to "1" level (namely, after the voltage waveform shown in (G) of FIG. 7 has gone from the "1" to "0" level), similarly as the NAND gate 328, the NAND gate 228 produces a "1" level signal for the time period $\alpha$ which is determined by the capacitor 226 this output signal is applied to the NAND gate 231 through the NAND gate 229. In this case, while the NAND gate 231 also receives the output of the inverter 230 as mentioned previously, at the expiration of the predetermined time after the connection of the power source B the transistor 224 is turned on and the output of the inverter 230 goes to the "1" level, the voltage waveform at an output terminal B of the NAND gate 231 goes to the "1" level only for the time period $\alpha$ as shown in (B) of FIG. 7.

Thus, following the closing of the key switch, the running time control circuit $7d_1$ and the stopping time control circuit $7d_2$ repeatedly perform the above-described operation with the result that the output of the timing control circuit *7d* which is delivered from the output terminal of the inverter 327 is, as shown in (K) of FIG. 7, the inverted signal of the signal shown in (F) of FIG. 7. In other words, this output signal is such that the length of its "0" level time $\tau_a$ increases as the engine rotational speeds increases and the length of its "1" level time $\tau_b (\tau_b = \tau_{b'} + 2\alpha)$ decreases as the intake manifold pressure decreases.

The command circuit *7e* comprises an inverter 150, NAND gates 151 and 152 and a NOR gate 153 and it provides control logics for the forward running, reverse running, running and stopping of the pulse motor 8. The command circuit *7e* receives, as its input signals, the signal from the timing control circuit *7d*, the signal from the comparison circuit *7a*, the pulse signals from the oscillator circuit *7h* comprising NAND gates 109 and 110 with expander terminals and capcitors 111 and 112, the duty cycle of the pulse signals being 1 : 1 and shown in (a) and (b) of FIGS. 8A and 8B and the signal from the valve-fully-closed switch 11 comprising a resistor 11*a* and a switch 11*b* which is closed when the control valve 10 is fully closed, and it produces command signals for operating the pulse motor 8.

Figure 8A:
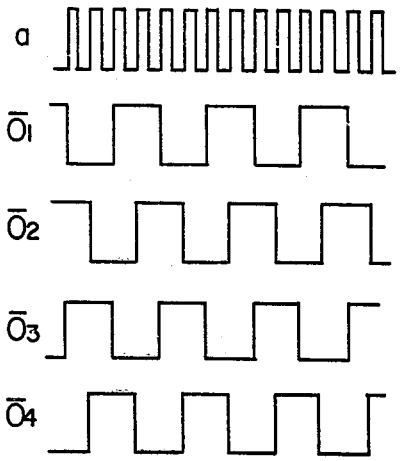
FIGS. 8A and 8B are characteristic diagrams which are useful in explaining the operation of the reversible shift register shown in FIG. 6.
Figure 8B:
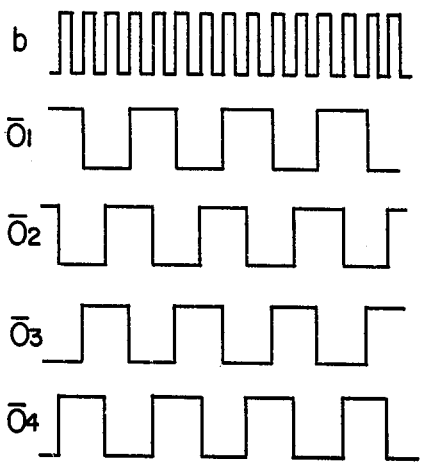

In other words, the signal from the timing control circuit *7d* shown in (K) of FIG. 7 and the signal from the oscillator circuit *7h* shown in (a) and (b) of FIGS. 8A and 8B are combined by the NOR gate 153 according to the NOR logic and then applied to the NAND gates 151 and 152, respectively. Consequently, the output of the NAND gates 151 and 152, respectively, consists of the signal from the oscillator circuit *7h* appearing in accordance with the engine rotational speed and the intake manifold vacuum, as for example, the signal consisting of pulse signals shown in (L) of FIG. 7. On the other hand, the output of the comparison circuit *7a* is applied to the NAND gate 152 directly and to the NAND gate 151 through the inverter 150, so that a "1" level signal is applied to one of the NAND gates 151 and 152 and one of the NAND gates 151 and 152 produces pulse signals as shown in (L) of FIG. 7 depending on whether the air-fuel ratio of the mixture is greater or smaller than the preset air-fuel ratio. Also the NAND gate 151 receives as its input signal the signal from the valve-fully-closed switch 11, so that when the control valve 10 is in its fully closed position, the NAND gate 151 is prevented from producing any pulse signals and operating the control valve 10 further in the valve closing direction.

Thus, the pulse signals corresponding to the engine rotational speed and the intake manifold pressure are applied to the reversible shift register *7f* in the manner depending on whether the air-fuel ratio of the mixture is greater or smaller than the preset air-fuel ratio. When the pulse signals are applied to one terminal P of the reversible shift register *7f*, its output terminals $Q_1$, $Q_2$, $Q_3$ $Q_4$ are sequentially shifted as shown in FIG. 8A. On the other hand, when the pulse signals are applied to the other terminal 0 of the reversible shift register *7f*, the output terminals $Q_4$, $Q_3$, $Q_2$ and $Q_1$ are sequentially shifted in this order as shown in FIG. 8B.

The output terminals $Q_1$, $Q_2$, $Q_3$ and $Q_4$ are connected to the switching circuit *7g* comprising resistors 160, 161, 162 and 163, transistors 164, 165, 166 and 167 and back electromotive force absorbing diodes 168, 169, 170 and 171 and this switching circuit *7g* is connected to field coils $C_1$, $C_2$, $C_3$ and $C_4$ of the four-phase pulse motor 8. Consequently, when the pulse signals are applied to the input terminal P of the reversible shift register *7f*, the transistors 164, 165, 166 and 167 are sequentially turned on, so that the field coils $C_1$, $C_2$, $C_3$ and $C_4$ of the pulse motor 8 are similarly energized two phases at a time and the rotor of the pulse motor 8 is rotated intermittently in the direction of the arrow in FIG. 6, thus intermittently rotating the control valve 10 in the direction which opens it. On the contrary, when the pulse signals are applied to the input terminal 0, the rotor of the pulse motor 8 is rotated in a direction direction opposite to the direction of the arrow shown in the Figure and the control valve 10 is intermittently rotated in the direction which closes it.

It will thus be seen that in accordance with the present invention, the feedback control is intermittently performed in such a manner that the running time $\tau_a$ and the stopping time $\tau_b$ of the pulse motor 8 are respectively determined with the function elements of the system delay time, i.e., the engine rotational speed and the intake manifold vacuum to accomplish the on-off control of the pulse motor 8.

Figure 10:
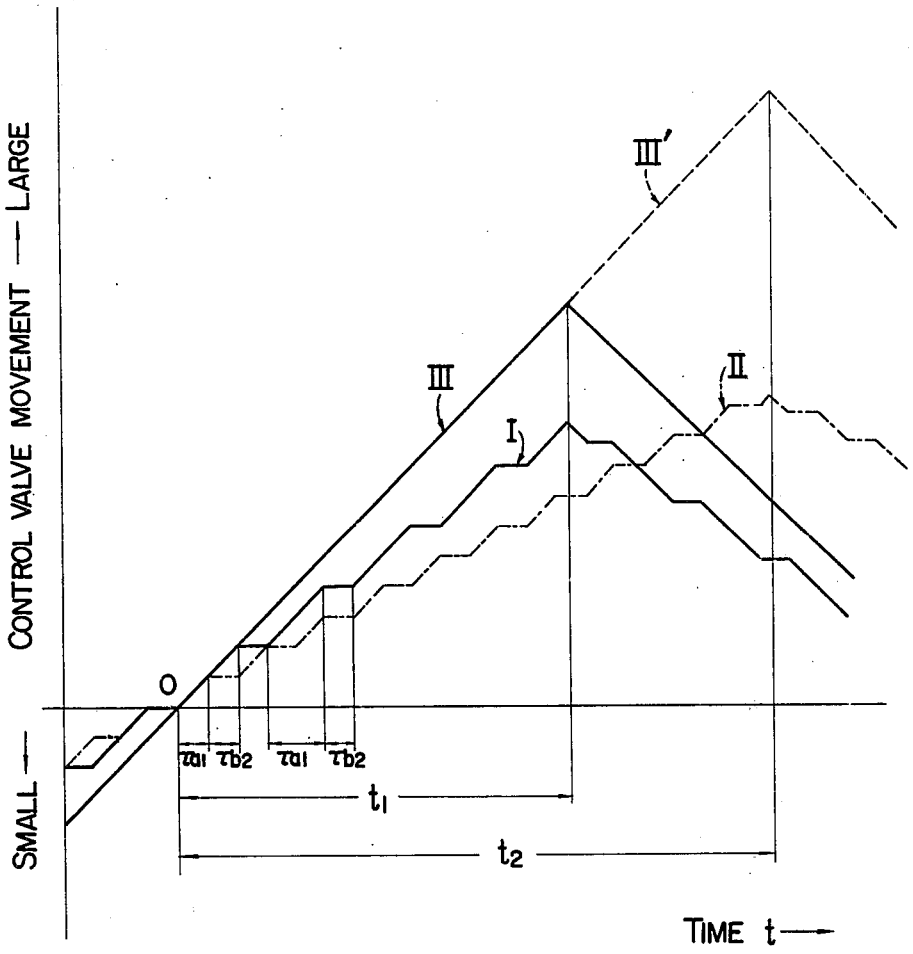
FIG. 10 is a characteristic diagram useful in explaining the operation of the embodiment shown in FIGS. 1 and 6.

Generally, with the intake manifold vacuum as a parameter, the relationship between the engine rotational speed and the system delay time takes a form as shown in FIG. 9. Thus, assuming that with the intake manifold vacuum maintained constant, a system delay time $t_1$ corresponds to an engine rotational speed I and a system delay time $t_2$ corresponds to an engine rotational speed II, if, in the conventional device employing an integral control system, the pulse motor driving frequency is fixed at any value which permits the response during acceleration periods, until a change in the air-fuel ratio of the mixture in the intake system is detected by the gas sensor in the exhaust system, the pulse motor is driven continuously and the control valve 10 is operated as shown by the broken lines III and III' in FIG. 10, thus increasing the amount of over-shoot and thereby supplying an excessively large amount of additional air. Consequently, the control range of the air-fuel ratio (namely, the range of deviation from the preset air-fuel ratio) is varied greatly and the adjustment of the air-fuel ratio to the preset air-fuel ratio is retarded. On the contrary, with the control device of this invention, even if the pulse motor driving frequency which is determined by the oscillation frequency of the oscillator circuit *7h* is fixed, when the engine rotational speed is low at II in FIG. 9 with the long delay time, the amount of movement of the control valve 10 by the pulse motor 8 is reduced as shown by the broken line II in FIG. 10 owing to the fact that the running time $\tau_a$ of the pulse motor 8 is reduced to $\tau_{a2}$ in FIG. 10 thus reducing the amount of over-shoot. Thus, as compared with the broken line III' for the conventional device, the amount of over-shoot is reduced fairly and the proper amount of additional air is supplied. On the other hand, where the engine rotational speed is high as at I in FIG. 9 with the short delay time during the period of acceleration, for example, the running time $\tau_a$ of the pulse motor 8 is increased as shown at $\tau_{a1}$ in FIG. 10 causing the amount of movement of the control valve 10 by the pulse motor 8 to change as shown by the broken line I in FIG. 10. Moreover, though not shown, during the period of acceleration, for example, since the intake manifold vacuum is generally decreased and the stopping time $\tau_b$ of the pulse motor 8 is also decreased, the control speed of the pulse motor 8 is increased thus ensuring satisfactory adjustment of the air-fuel ratio to the present air-fuel ratio.

The present invention is not intended to be limited to the above-described embodiment. For example, while the invention has been described as embodied in an internal conbustion engine equipped with a carburetor, the control device can be adapted for compensating the rate of flow of the air in the metering device of the mechanically controlled fuel injection systems and the like. Further, while a pulse motor is used as driving means for operating the control valve to control the amount of additional air, any of DC and AC motors may equally be used in addition to other devices which control the operation of the control valve mechanically and not electrically.

Still further, while an engine speed sensor and a vacuum sensor are employed as system delay detecting means, any sensors for sensing other delay time factors of the system such as intake air flow, venturi vacuum, throttle position, etc., may also be used.

Still further, while the present invention has been described as applied to the control of the air-fuel ratio in the intake system, it can be adpated for the control of the air flow in the exhaust system, such as, the control of the secondary air flow to the catalyst through the use of a gas sensor of the type used with the invention.

Still further, while the timing control circuit *7d* utilizes a constant current charging and discharging system, other circuit of the type employing a constant voltage charging and discharging system may be employed depending upon the delay time characteristic of a system.

We claim:

1. An additional air control device for an internal combustion engine which has an intake system and an exhaust system comprising:

a carburetor connected to the intake system of said internal combustion engine and including a main passage and a bypass passage, for supplying air-fuel mixture to said engine;

said main passage being provided with a throttle valve for controlling an amount of air-flow, and said bypass valve being provided with a control valve for compensating the air-fuel ratio of said air-fuel mixture by controlling an amount of additional air-flow flowing therethrough;

a drive motor coupled to said control valve for driving the same in order to control the opening degree of said control valve;

gas sensing means mounted in the exhaust system of said engine for sensing the oxygen content of the exhaust gases therein and deriving an electrical gas sensing signal;

engine speed sensing means for sensing the rotational speed of said engine and thereby producing an electrical rotational speed signal;

pressure sensing means for sensing the vacuum produced in the intake system of said engine and thereby producing an electrical vacuum signal; and electronic control means electrically connected to said gas sensing means, said engine speed sensing means, said pressure sensing means and said drive motor for alternately driving and stopping said drive motor repeatedly in a selected direction in according with said gas sensing signal, said rotational speed signal and said vacuum signal;

said electronic control means including a comparison circuit for receiving the gas sensing signal from said gas sensing means and comparing the same with a preset value to determine whether said gas sensing signal is greater or smaller than said preset value and thereby determine the direction of operation of said drive motor, a running time control circuit for receiving said rotational speed signal to control the running time of said drive motor, a stopping time control circuit for receiving said vacuum signal to control the stopping time of said drive motor, and a switching circuit responsive to the signals from said comparison circuit, said running time control circuit and said stopping time control circuit to operate said drive motor.

2. An additional air control device for an internal combustion engine which has an intake system, an exhaust system, and a catalytic converter for purifying exhaust gases comprising:

a carburetor connected to the intake system of said internal combustion engine and including a passage for supplying substantially rich air-fuel mixture, said passage being provided with a throttle valve for controlling an amount of air-flow;

means defining a bypass passage for supplying additional air to the downstream side of said throttle valve;

a control valve mounted in said bypass passage for controlling the amount of additional air flowing therethrough;

drive means coupled to said control valve for driving said control valve to open and close;

gas sensing means mounted in the exhaust system of said engine upstream of said catalytic converter for producing a gas sensing signal corresponding to the composition of exhaust gases flowing through said exhaust system;

rotational speed sensing means for sensing the rotational speed of said engine and thereby producing an electrical digital rotational speed signal;

pressure sensing means for sensing the vacuum produced in said intake system of said engine and thereby producing an electrical vacuum signal; and electronic control means operatively connected to said gas sensing means, said rotational speed sensing means, said pressure sensing means and said drive means;

said electronic control means being responsive to said gas sensing signal, said digital rotational speed signal and said vacuum signal for alternately driving and stopping said drive means repeatedly in a selected direction; and said electronic control means including a comparison circuit for receiving said gas sensing signal and comparing the same with a preset value to determine whether said gas sensing signal is greater or smaller than said preset value and thereby determine the direction of operation of said drive means, a D-A converter circuit for converting said digital rotational speed signal into an analog signal by D-A conversion, a timing control circuit for receiving said analog signal and said vacuum signal to determine the running time and stopping time of said drive means, and a switching circuit responsive to the signals from said comparison circuit and said timing control circuit for producing a drive means driving signal, whereby the air-fuel ratio of mixture supplied to said engine is maintained at a stoichiometric air-fuel ratio to properly adjust the composition of exhaust gases flowing into said catalytic converter.

3. An additional air control device for an inernal combustion engine which has an intake system and an exhaust system comprising:

air-fuel mixture supply means provided in the intake system of said internal combustin engine;

an air pipe disposed to supply additional air to said engine;

a bypass valve mounted in said air pipe to control the amount of additional air supplied therethrough;

drive means coupled to said bypass valve for driving said bypass valve to open and close;

gas sensing means mounted in the exhaust system of said engine for producing a gas sensing signal corresponding to the composition of exhaust gases flowing through said exhaust system;

first delay time factor detecting means for detecting a first delay time factor between the occurrence of a change in the air-fuel ratio of the mixture supplied to said intake system and the detection by said gas sensing means of said change in the form of a change in the composition of the exhaust gases in said exhaust system to produce a first electrical detection signal;

second delay time factor detecting means for detecting a second delay time factor between the occurrence of a change in the air-fuel ratio of the mixture supplied to said intake system and the detection by said gas sensing means of said change in the form of a change in the composition of the exhaust gases in said exhaust system to produce a second electrical detection signal; and a control unit connected to said gas sensing means, said first and second delay time factor detecting means and said drive means;

said control unit being responsive to the gas sensing signal from said gas sensing means for operating said drive means in selected one of the bypass valve opening and closing directions, said control unit being responsive to the first detection signal from said first delay time factor detecting means for causing a skip movement of said drive means for a period of time substantially proportional to said first delay time factor and thereafter responding to the second detection signal from said second delay time factor detecting means to stop said drive means for another period of time substantially inversely proportional to said second delay time factor, said skip movement and said stopping of said drive means being repeated alternately.

4. A device according to claim 2 further comprising a valve-fully-closed switch coupled to said control valve for detecting and producing a fully closed position signal when said control valve has been moved into its fully closed position, said valve-fully-closed switch being connected electrically to said control unit whereby when said control valve is in said fully closed position, said control unit prevents said drive means from being operated in a direction which drives said control valve further in the valve closing direction thereof.

* * * * *